US009420893B1

(12) United States Patent
Clark

(10) Patent No.: US 9,420,893 B1
(45) Date of Patent: Aug. 23, 2016

(54) KNEELER

(71) Applicant: Bruce A. Clark, St. Paul, MN (US)

(72) Inventor: Bruce A. Clark, St. Paul, MN (US)

( * ) Notice: Subject to any disclaimer, the term of this patent is extended or adjusted under 35 U.S.C. 154(b) by 0 days.

(21) Appl. No.: 15/090,803

(22) Filed: Apr. 5, 2016

Related U.S. Application Data

(63) Continuation-in-part of application No. 29/505,033, filed on May 4, 2015.

(51) Int. Cl.
*A47C 16/04* (2006.01)
*E05B 1/00* (2006.01)
*A47C 7/62* (2006.01)

(52) U.S. Cl.
CPC . *A47C 16/04* (2013.01); *A47C 7/62* (2013.01); *E05B 1/0069* (2013.01)

(58) Field of Classification Search
CPC ..... E05B 1/0069; A47C 16/04; A47C 7/62
See application file for complete search history.

(56) References Cited

U.S. PATENT DOCUMENTS

| | | | | |
|---|---|---|---|---|
| 830,103 | A | 9/1906 | Rundell | |
| 1,529,498 | A | 3/1925 | Novak | |
| 2,225,696 | A | 12/1940 | Holzderber | |
| 2,318,416 | A | 5/1943 | Peirce | |
| 2,448,427 | A * | 8/1948 | Gordon | A47C 9/027 182/230 |
| 2,829,705 | A | 4/1958 | Godshalk et al. | |
| 4,394,049 | A | 7/1983 | Ward | |
| D273,996 | S | 5/1984 | Rasler | |
| 4,606,576 | A | 8/1986 | Jones | |
| D287,074 | S | 12/1986 | Ritchie | |
| D288,513 | S | 3/1987 | Shelly | |
| 4,798,264 | A * | 1/1989 | Miller | A47C 16/04 182/228.1 |
| D305,522 | S | 1/1990 | Kohus | |
| D311,282 | S | 10/1990 | Tooley | |
| 4,971,389 | A | 11/1990 | Staggs | |
| 5,125,646 | A * | 6/1992 | Wilkinson | A47B 9/14 248/188.2 |
| D331,330 | S | 12/1992 | Bennett et al. | |
| D346,310 | S | 4/1994 | Schlesier et al. | |
| D351,738 | S | 10/1994 | Lacombe | |
| D369,842 | S | 5/1996 | Gvoich | |
| D376,481 | S | 12/1996 | Bidwell et al. | |
| D387,623 | S | 12/1997 | Brooks | |
| D423,290 | S | 4/2000 | Green | |
| D435,196 | S | 12/2000 | Gregor et al. | |
| D463,039 | S | 9/2002 | Tseng | |
| D510,699 | S | 10/2005 | Crain et al. | |
| D541,433 | S | 4/2007 | Wise | |
| D612,160 | S | 3/2010 | Carino | |
| D685,110 | S | 6/2013 | Lusin et al. | |
| D736,002 | S * | 8/2015 | Clark | D6/330 |
| D736,525 | S * | 8/2015 | Clark | D6/330 |
| 2002/0089227 | A1 * | 7/2002 | Speraw | A47C 16/04 297/423.11 |
| 2004/0201268 | A1 | 10/2004 | Liao | |
| 2007/0205054 | A1 * | 9/2007 | Gentles | A47C 16/04 182/230 |

FOREIGN PATENT DOCUMENTS

| | | |
|---|---|---|
| GB | 762869 | 12/1956 |

* cited by examiner

*Primary Examiner* — Philip Gabler
(74) *Attorney, Agent, or Firm* — Richard O. Bartz

(57) ABSTRACT

A kneeler supporting a person in a kneeling position has a platform with a cushion for a person's knees and upright handles with feet attached to opposite ends of the platform to facilitate a person to move from an upright position to a kneeling position and move back from a kneeling position to an upright position.

25 Claims, 11 Drawing Sheets

KNEELER

CROSS REFERENCE TO RELATED APPLICATION

This application is a continuation-in-part of U.S. patent application Ser. No. 29/505,033 filed May 4, 2015.

FIELD OF INVENTION

The invention is in the art of a support for a person in a kneeling position that facilitates movement of the person from an upright position to a kneeling position and arising from a kneeling position to an upright position.

BACKGROUND OF THE INVENTION

Kneeler devices have been used to provide support when a person is kneeling and performing tasks such as cleaning a floor or object, painting gardening or meditation. Kneeling is important for a person to maintain activity level and overall function. Without the ability to get into and out of a kneeling position, older persons have no way to get up off the floor after a fall. These kneeler devices have platforms or boards with cushions to support a person in a comfortable kneeling position. Handles associated with the platforms provide structures for aiding a person using the kneeler device in assuming a kneeling position and arising therefrom. Examples of kneeling aids and stools are disclosed in U.S. Pat. Nos. 2,318,416 and 4,850,069.

Bacterial touch surface contamination in hospital and medical clinic is associated with inadequate cleaning of equipment and rooms. Studies have been conducted to assess whether a lower environment bio-burden on critical touch surfaces would result in a lower risk of contracting an infection while hospitalized. Kneeler devices have not addressed bacterial contamination during use, transport and storage of the kneeler devices. There is a continuing need for a kneeler device that is easy to assemble without tools and effective to minimize microorganism contamination in an environment, including hospitals, medical clinics and physical therapy facilities.

The inability of a person to kneel after knee surgery is a cause of dissatisfaction. Kneeling can be a painful experience for persons with degenerative conditions of the knee both before and after surgery. No kneeling after surgery limits a person's ability to perform the activities of daily living. Some persons may need to kneel to return to perform to full employment and other persons may need to kneel to care for children or undertake leisure activities such as gardening and home improvement. Some religions have ceremonies that include the ability to kneel. All these activities contribute to improving a person's quality of life. Physical therapy intervention can improve a person's kneeling ability following knee surgery. Experienced therapist during routine clinic visits can provide a person with clear advice and instructions on kneeling and use of a kneeling device. Barriers to kneeling include scar position, numbness, range of flexion, involvement of other joints and pain. Kneeling ability with a therapist and a kneeling device can mitigate these barriers to a person's kneeling.

SUMMARY OF THE INVENTION

The kneeler of the invention has a platform and handles attached to opposite ends of the platform. The platform supports a cushion which functions as a rest for the knees of a person in a kneeling position. Bosses on the four corners of the platform have upwardly converging conical pockets and associated openings. Feet attached to the handles have cone stems located in the pockets that are in compression engagement with the bosses to firmly mount the handles on the platform. Each handle has legs with lower ends accommodating the feet. When the lower ends of the handles and feet are inserted through the openings and moved into the pockets, the feet vertically and laterally lock the handle on the platform. The handles can be removed from the platform by moving the feet out of pockets in the bosses and then moving the legs and feet into the openings to allow the handle to be separated from the platform. The assembly and release of the handles relative to the platform is accomplished without tools and separate connecting structures. The handles have antimicrobial copper alloy legs and feet which substantially destroys microorganisms that adhere on the legs and feet. The platform can also have antimicrobial materials that inhibit microorganism contamination. The kneeler has three components, the platform and two handles attached to feet, that can be assembled and taken apart in a minimum amount of time without tools or extra hardware. The handles can be identical or have different lengths for special needs. The kneeler has numerous uses, including but not limited to gardening, home and institutional cleaning, painting and carpet installation. Further use of the kneeler includes physical therapy exercising and assistance for informed and elderly persons.

DESCRIPTION OF THE KNEELER

Figure 2:
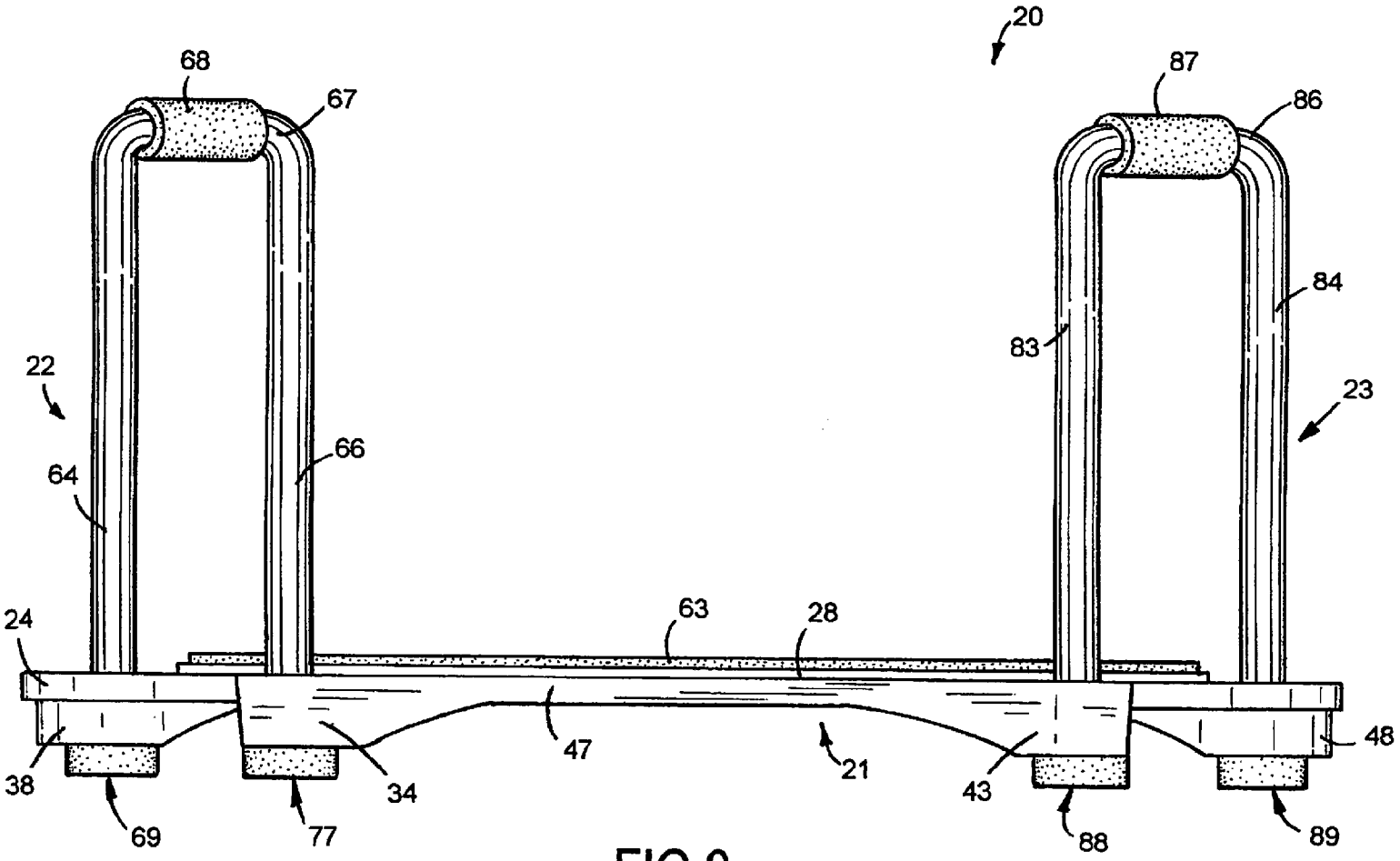
FIG. 2 is a front elevational view thereof.
Figure 11:
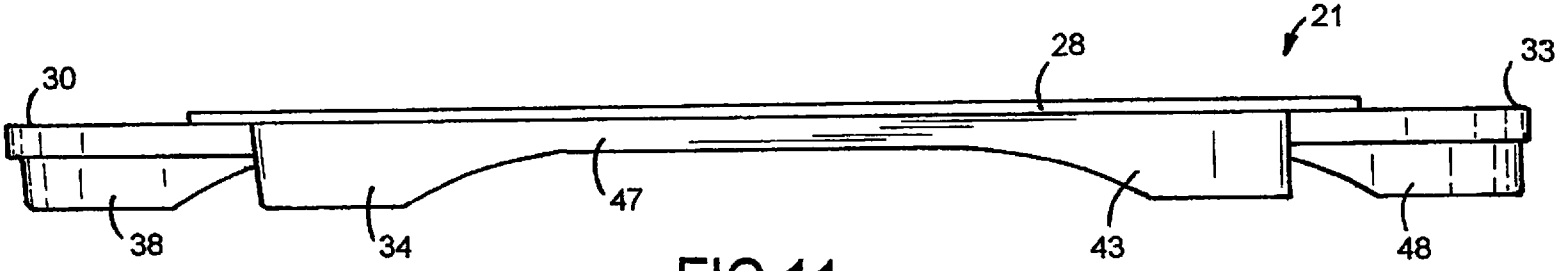
FIG. 11 is a front elevational view of FIG. 10.

Kneeler 20, shown in FIGS. 11 and 2, has a flat platform 21 and upright handles 22 and 23 mounted on opposite ends of the platform. Handles 22 and 23 are used by a person to facilitate the person to move from a standing position to a kneeling position on platform 21 and back from a kneeling position on platform 21 to a standing position. Handles 22 and 23 also provide barriers to prevent a kneeling person from falling on or off of platform 21. Handles 22 and 23 are attached to opposite corners of platform 21 with cooperating lock structures that allow handles 22 and 23 to be attached to and removed from platform 21 without tools or additional structures.

Figure 10:
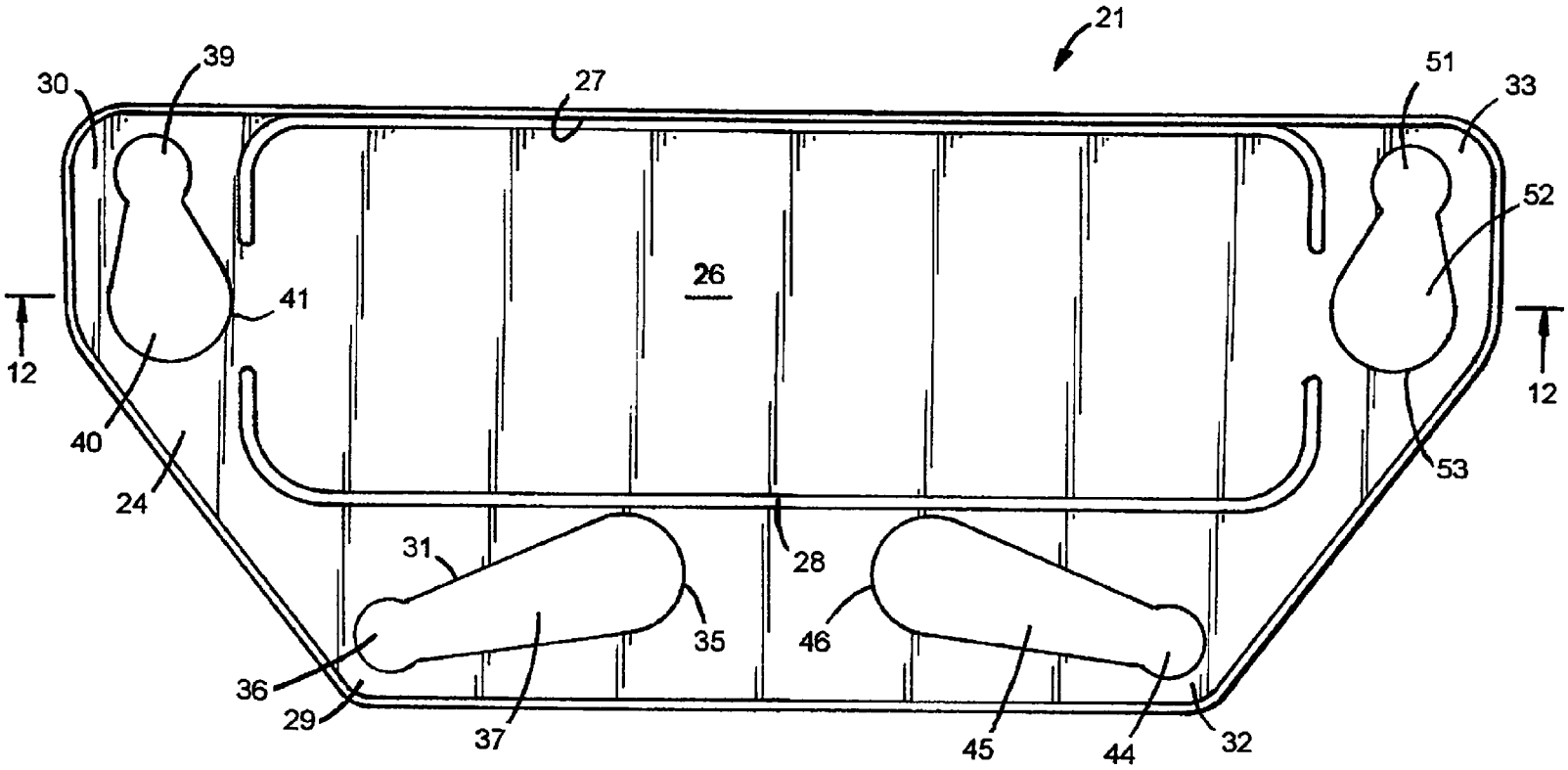
FIG. 10 is a top plan view of the platform of the kneeler of FIG. 1.
Figure 12:
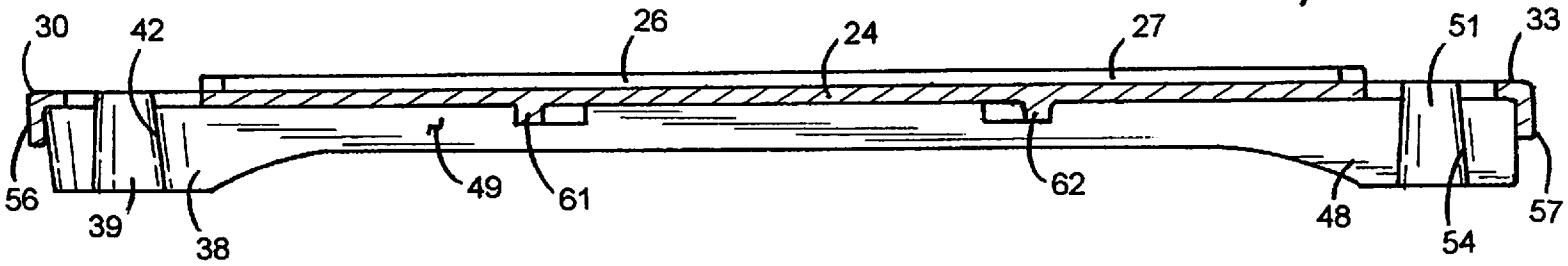
FIG. 12 is a sectional view taken along line 12-12 of FIG. 10.

Platform 21, as shown in FIG. 10, has a base or plate 24 having a flat top surface 26 and upright ribs 27 and 28 around surface 26. The left end of platform 21 has front and rear corners 29 and 30. The right end of platform 21 has front and rear corners 32 and 33. Corner 29 has a downward projected boss 34 having a pocket or hole 36 and an elongated oblong opening 37 extended inwardly from pocket 36. Base 24 has side walls 31 on opposite sides of opening 37 that diverge inwardly away from pocket 36 and terminates in a semi-circular inner end 35. The diameter of the semi-circular end 35 is greater than the diameter of pocket 36. Corner 30 has a downwardly projected boss 38 having a pocket or hole 39 in communication with an elongated oblong opening 40 having a semi-circular lower end 41. As shown in FIG. 12, boss 38 has a conical upwardly converging side wall 42. The longitudinal axes of openings 37 and 41 are separated by an angle of 80 degrees. Other angular relationships of the longitudinal axes of openings 37 and 41 can be used to accommodate handle 22. Corner 32 has a downwardly projected boss 43 having a pocket or hole 44 and an elongated oblong opening 45 extended inwardly from pocket 44 opening. Opening 45 diverges inwardly away from pocket 44 and terminates in a semi-circular inner end 46. Semi-circular inner end 45 has a diameter larger than the diameter of pocket 44. As shown in FIGS. 2 and 11, base 24 has a front wall 47 joined to bosses 34 and 43. Corner 33 has a downwardly projected boss 48 joined to a rear wall 49 extended to boss 38. As shown in FIGS. 10 and 12, boss 48 has a pocket or hole 51 and an elongated oblong opening, 52 extended downwardly from pocket 33. Opening 52 diverges downwardly from pocket 51 and terminates in a semi-circular end 53. The diameter of the semi-circular end 53 is greater than the diameter of pocket 51. As shown in FIG. 12, boss 48 has an upward conical wall 54 surrounding pocket 51.

Pockets 36, 39, 44 and 51 and adjacent openings 37, 40, 45 and 52 each have the same size and configuration. Openings 40 and 52 are oblong diverging keyhole shaped slots in base 24 located inwardly of base end walls 56 and 57. Openings 37 and 45 are oblong diverging keyhole shaped slots in base 24 located adjacent front wall 47. The distance between the centers of pockets 36 and 39 is the same as the distance between the centers of semi-circular ends 35 and 41. Also, the distance between the centers of pockets 44 and 51 is the same as the distance between the centers of semi-circular ends 35 and 46. The distance between the centers of pockets 36 and 39 is the same as the distance between the centers of pockets 44 and 51 whereby the base 24 can be used with handles having the same sizes and shapes. The entrances of openings 37, 40, 45 and 52 to pockets 36, 39, 44 and 51 are smaller than the diameters of pockets 36, 39, 44 and 51 and have widths that allow the lower ends of the legs of the handles 22 and 23 to be moved through the entrance openings and into the pockets 36, 39, 44 and 51.

Figure 14:
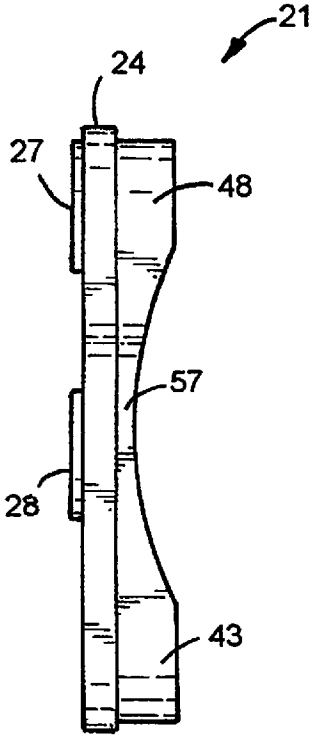
FIG. 14 is a right side elevational view of FIG. 10.
Figure 13:
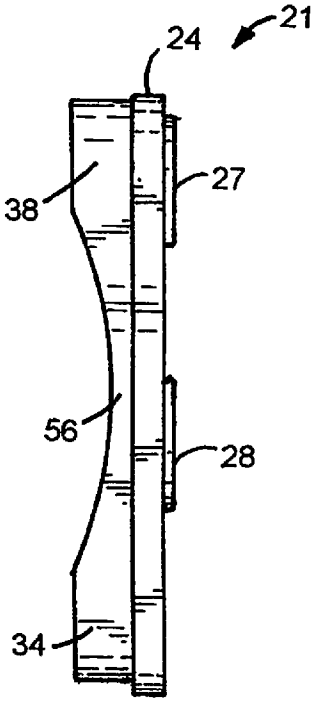
FIG. 13 is a left side elevational view of FIG. 10.
Figure 15:
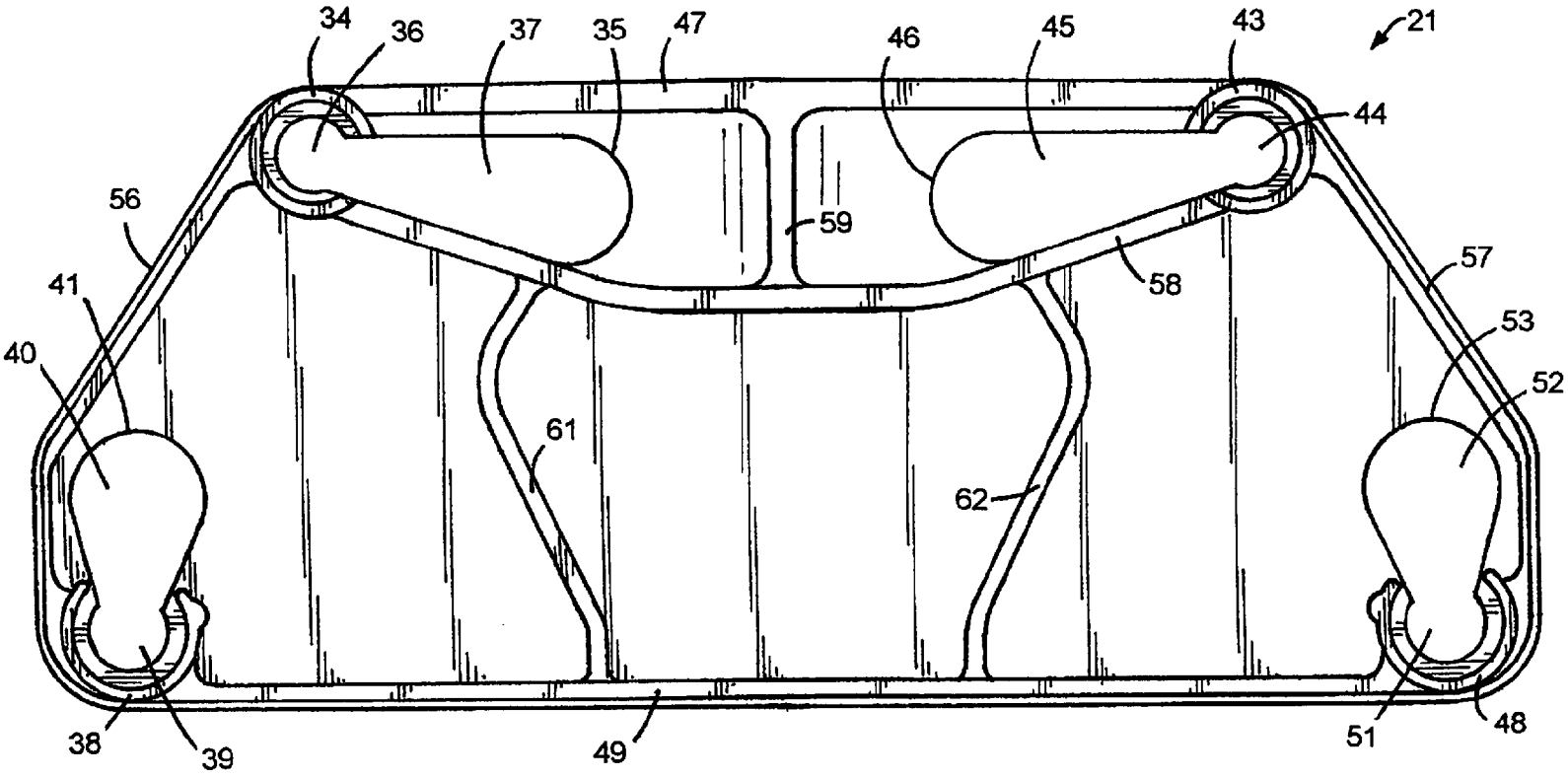
FIG. 15 is a bottom plan view of FIG. 10.

Base 24 has an end wall 56, shown in FIGS. 13 and 15, joined to bosses 34 and 38. An end wall 57, shown in FIGS. 14 and 15, joins bosses 43 and 48. A bottom transverse rib 58 is joined to base 24 and bosses 34 and 43. A short rib 59 joins the middle sections of wall 47 and rib 58. A pair of curved ribs 61 and 62 join rib 58 to rear wall 47. The peripheral walls 47, 49, 56 and 57 along with ribs 58, 59, 61 and 62 reinforce base 24 and maintain the flat configuration of base 24. Peripheral walls 47, 49 56 and 57 is a continuous flange around base 24 providing base 24 with peripheral strength. Base 24 does not have peripheral recesses and cut outs.

A generally rectangular cushion or pad 63, shown in FIGS. 1 to 4, located on top surface 26 of base 24 provides an elastic member for supporting a person's knees in the kneeling position. Pad 63 is surrounded by ribs 27 and 28. An adhesive or bonding material secures the bottom surface of pad 63 to top surface 26 of base 24. Pad 63 can be a one piece structure of elastic material, such as closed cell plastic. Other materials can be used as cushion structure for pad 63.

Handles 22 and 23, shown in FIGS. 1 to 4, are inverted U-shaped members releasable retained on opposite end sections of platform 21. Pad 63 extended horizontally between handles 22 and 23 provide support for a person to facilitate kneeling on and off of pad 63.

Handle 22 has tubular upright legs 64 and 66 joined to a tubular top cross member 67. The vertical lengths of legs 64 and 66 can vary. For example, each leg 64 and 66 can have a vertical length between 12 to 18 inches. A sleeve or cylindrical hand grip 68 of elastic material is located around cross member 67. Steel, aluminum and copper alloys can be used to fabricate legs 64 and 66 and cross member 67. Legs 64 and 66 and cross member 67 can be an antimicrobial copper product that reduces bacterial contamination and kill bacteria exposed to the surfaces of legs 64 and 66 and cross member 67. Examples of these copper products are C11000 copper, copper silicon alloy C87610 and 355 copper alloys registered with the U.S. Environmental Protection Agency.

Figure 3:
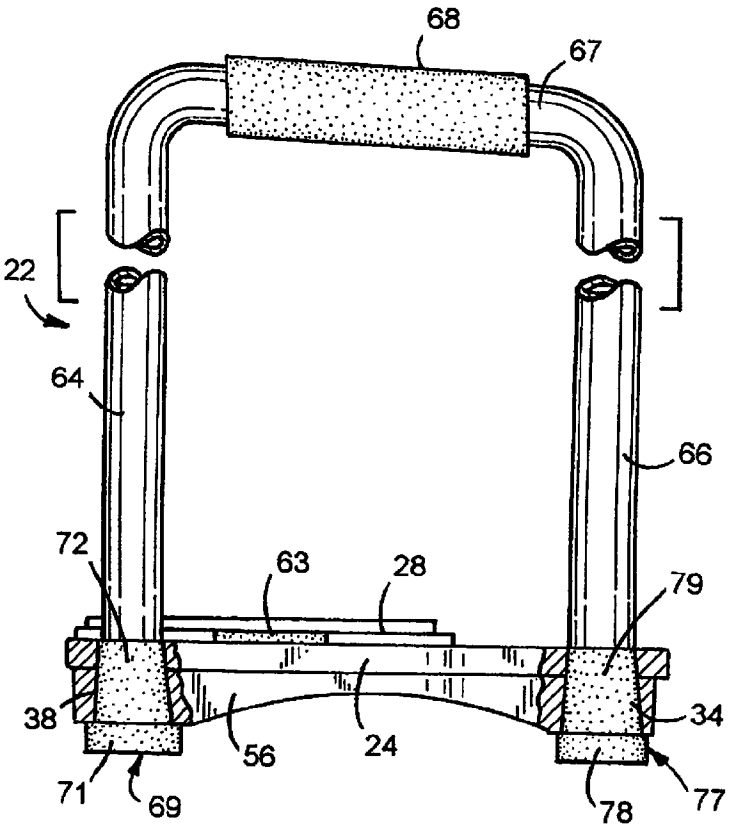
FIG. 3 is a foreshortened and partly sectional left end elevational view thereof.
Figure 7:
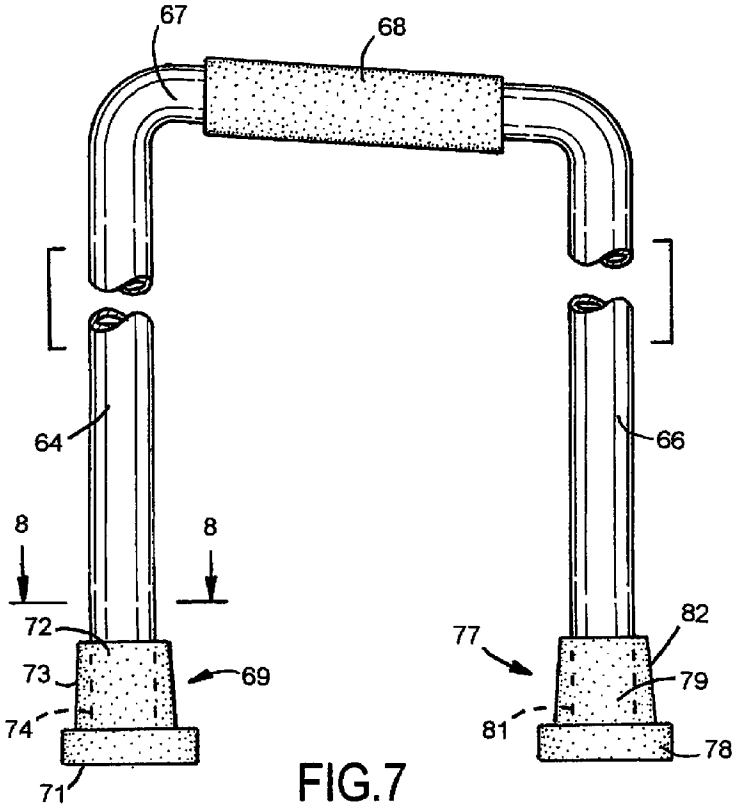
FIG. 7 is a foreshortened front elevational view of a handle of the kneeler.
Figure 8:
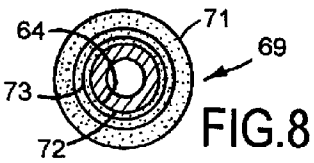
FIG. 8 is a sectional view taken along line 8-8 of FIG. 7.
Figure 6:
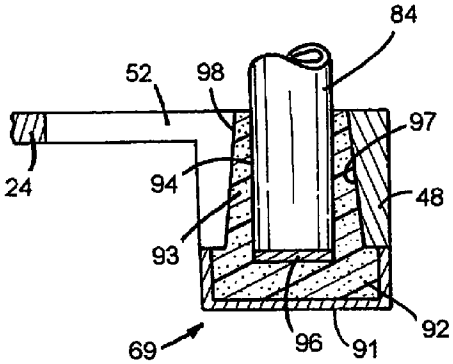
FIG. 6 is an enlarged sectional view taken along line 6-6 of FIG. 4.
Figure 9:
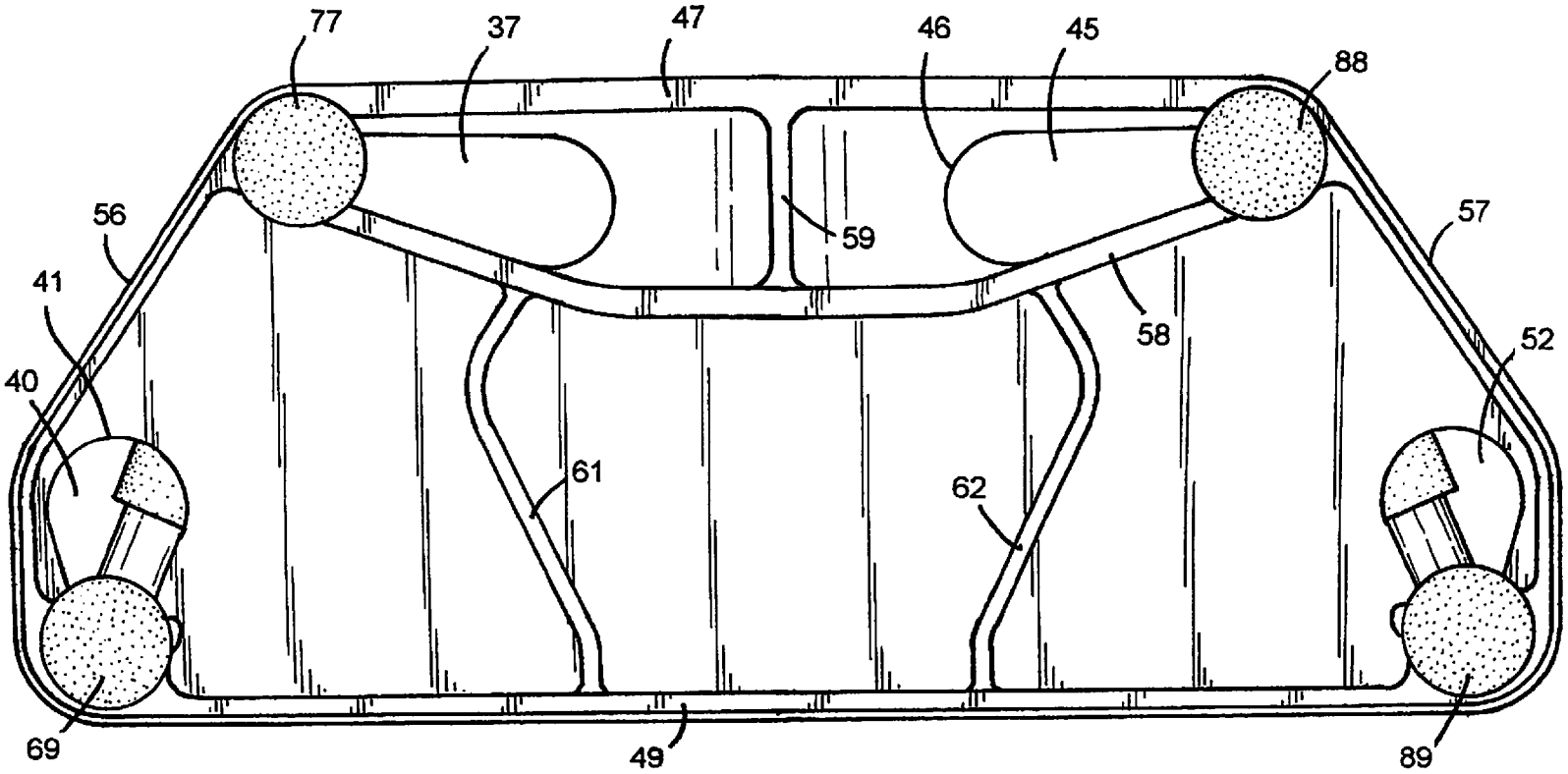
FIG. 9 is a bottom plan view thereof.

As shown in FIGS. 3 and 7, a first foot 69 is attached to the lower end of leg 64. Foot 69 is a rubber or a plastic member having a cylindrical sole or base 71 and an upright stem 72. Stem 72 has an upward converging conical side wall 73 and a cylindrical blind hole 74. As shown in FIG. 6, a metal disk 76 located at the bottom of hole 74 provides support for the bottom of leg 64 located on hole 74. A second foot 77 attached to the lower end of leg 66 has the same structure as foot 69. Foot 77 has a cylindrical sole or base 78 joined to an upright stem 79. Stem 79 has a blind hole 81 and an upward converging conical side wall 82. The lower end of leg 66 is telescoped in blind hole 81 to attach foot 77 to leg 66.

Figure 1:
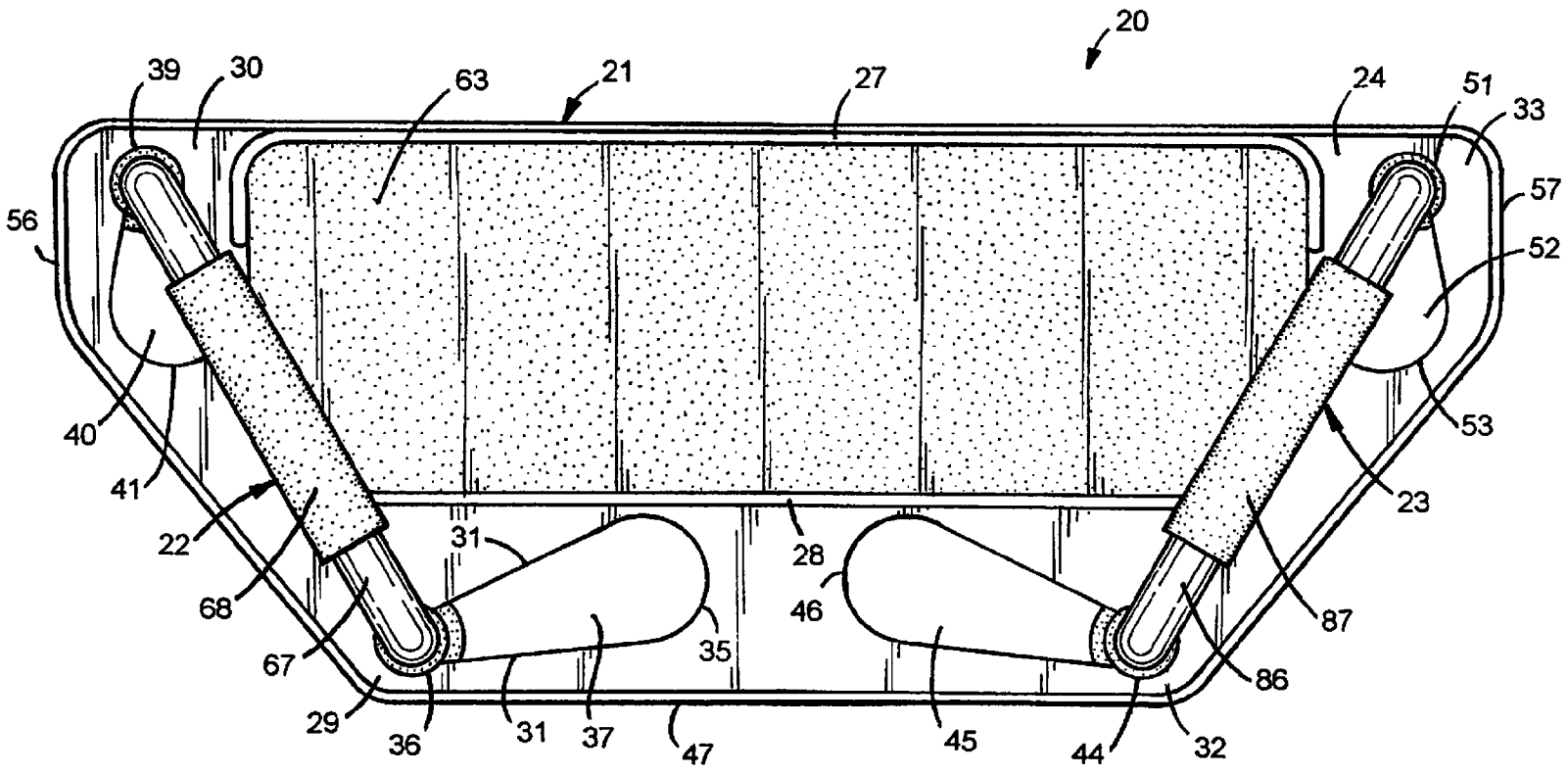
FIG. 1 is a top plan view of the kneeler of the invention.
Figure 4:
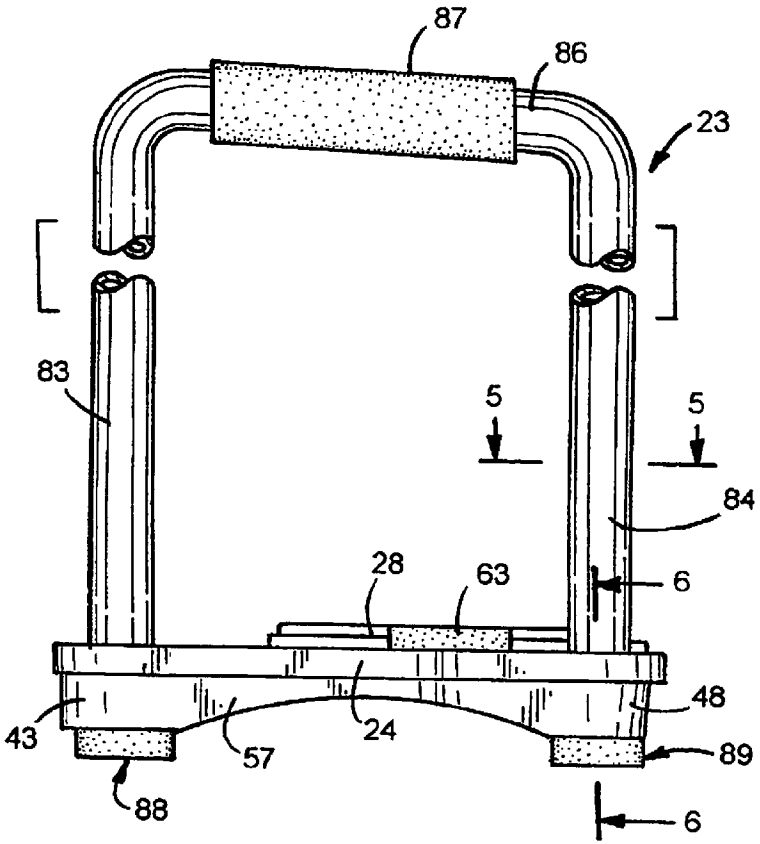
FIG. 4 is a foreshortened right end elevational view thereof.

Handle 23, shown in FIGS. 1, 2 and 4, has tubular upright legs 83 and 84 joined to a tubular cross member 86. Legs 83 and 84 and cross member 86 are a one-piece metal inverted U-shaped tubular member. A sleeve or cylindrical hand grip 87 extends around cross member 86. Handle 23 has the same size and material as handle 22. Feet 88 and 89 are connected to the lower ends of legs 83 and 84. Feet 88 and 89 have the same size and shape as feet 69 and 77. As shown in FIG. 6, a copper cup 91 is located around sole 71 of foot 69 to provide antimicrobial effect to foot 69. Copper cups can be added to feet 77, 88 and 89. The soles of the feet can be solid copper or a copper alloy.

Figure 5:
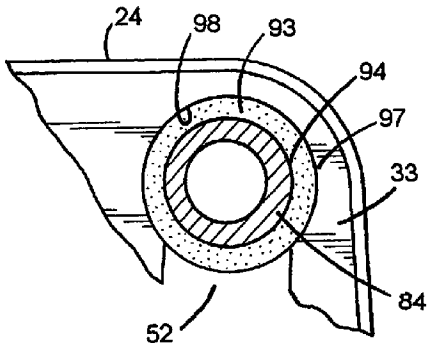
FIG. 5 is an enlarged sectional view taken along line 5-5 of FIG. 4.

As shown in FIGS. 5 and 6, leg 84 of handle 23 telescope into foot 89. Foot 89 has a cylindrical base or sole 92 joined to an upright stem 93. Stem 93 has a downwardly extended blind cylindrical hole 94 and a peripheral conical wall 98. A metal disk 96 is located at the bottom of hole 94. The lower end of leg 84 located in hole 94 contacts disk 94. The disk 94 prevents leg 84 from cutting into sole 92. Boss 48 has an upwardly converging conical wall 97 located in compression engagement with the outer tapered wall 98 of stem 93. Conical wall 97 of boss 48 has a taper of 6 degrees relative to the vertical axis of pocket. Conical wall 98 has an upward converging taper of 5 degrees relative to the vertical axis of stem 93. The difference in the tapers of walls 97 and 98 allows foot 89 to be released from boss 48 when leg 23 is moved downward relative to base 24. Other tapers of walls 97 and 98 can be used to fit stem 93 into pocket 51 and allow stem 93 to be removed from pocket 51. Feet 69, 77, and 88 each have the same size and shape as foot 89.

Figure 18:
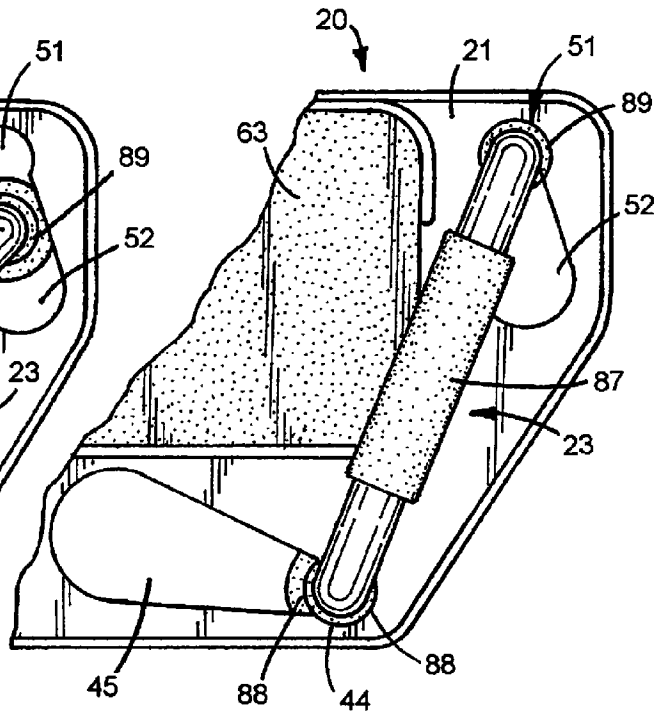
FIGS. 16, 17 and 18 are top plan views of the right side of the kneeler of FIG. 1 showing the method of assembly of a handle on the platform.
Figure 17:
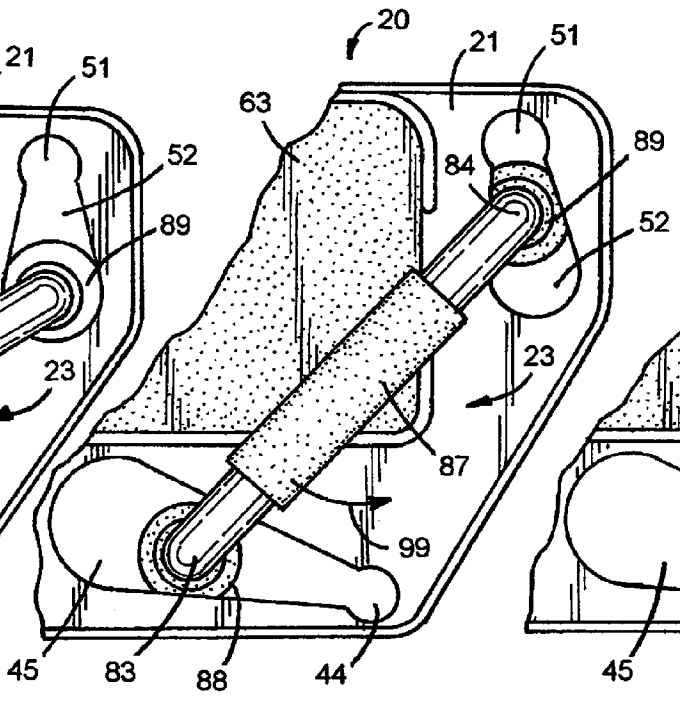
Figure 16:
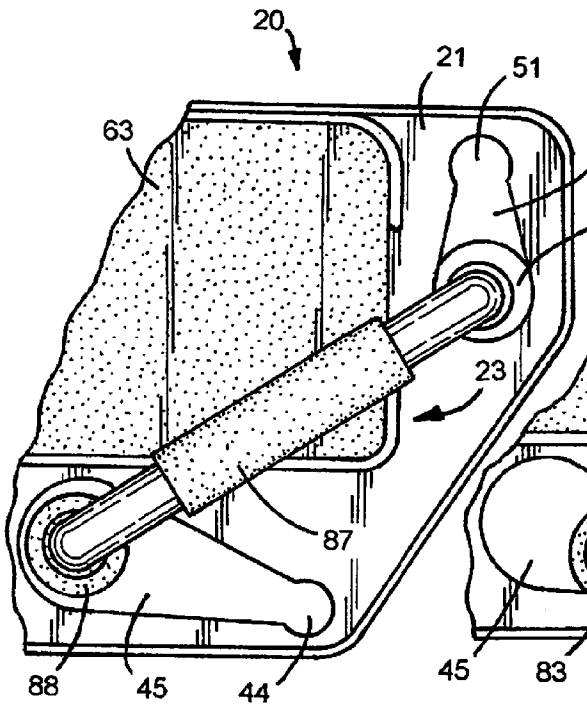

The assembly of handle 23 onto platform 21 is illustrated in FIGS. 12 to 18. The assembly of handle 22 onto platform 21 is the same as the assembly of handle 23 onto platform 21. As shown in FIG. 16, handle 23 is located above platform 21 with feet 88 and 89 positioned adjacent the large sections of openings 45 and 52. The large sections of openings 45 and 52 has diameters larger than the diameters of cylindrical soles of feet 88 and 89. Handle 23 and feet 88 and 89 are moved down through openings 45 and 52 to locate feet 88 and 89 below platform 21. Handle 23, as shown in FIG. 17, is then turned counterclockwise, as shown by arrow 99, to move feet 88 and 89 and legs 83 and 84 below openings 45 and 52 toward pockets 44 and 51. The lower ends of legs 83 and 84 are moved through the entrances to pockets 44 and 51 to locate feet below pockets 44 and 51. FIG. 18 shows feet 88 and 89 positioned in pockets 44 and 51. Handle 87 is raised relative to platform 21 to position the stems of feet 88 and 89 in compression engagement with the conical walls of pockets 44 and 56. When stems of feet 88 and 89 fit tight in pockets 44 and 56, handle 23 is locked onto platform 21. Handles 23 cannot be moved laterally outward and forward and reversed relative to platform 21. Handle 22 is assembled on platform 21 in the same manner of assembly of handle 23 on platform 21. Handles 22 and 23 are removed from platform 24 by reversing the process of attaching handles 22 and 23 to platform 21.

Figure 19:
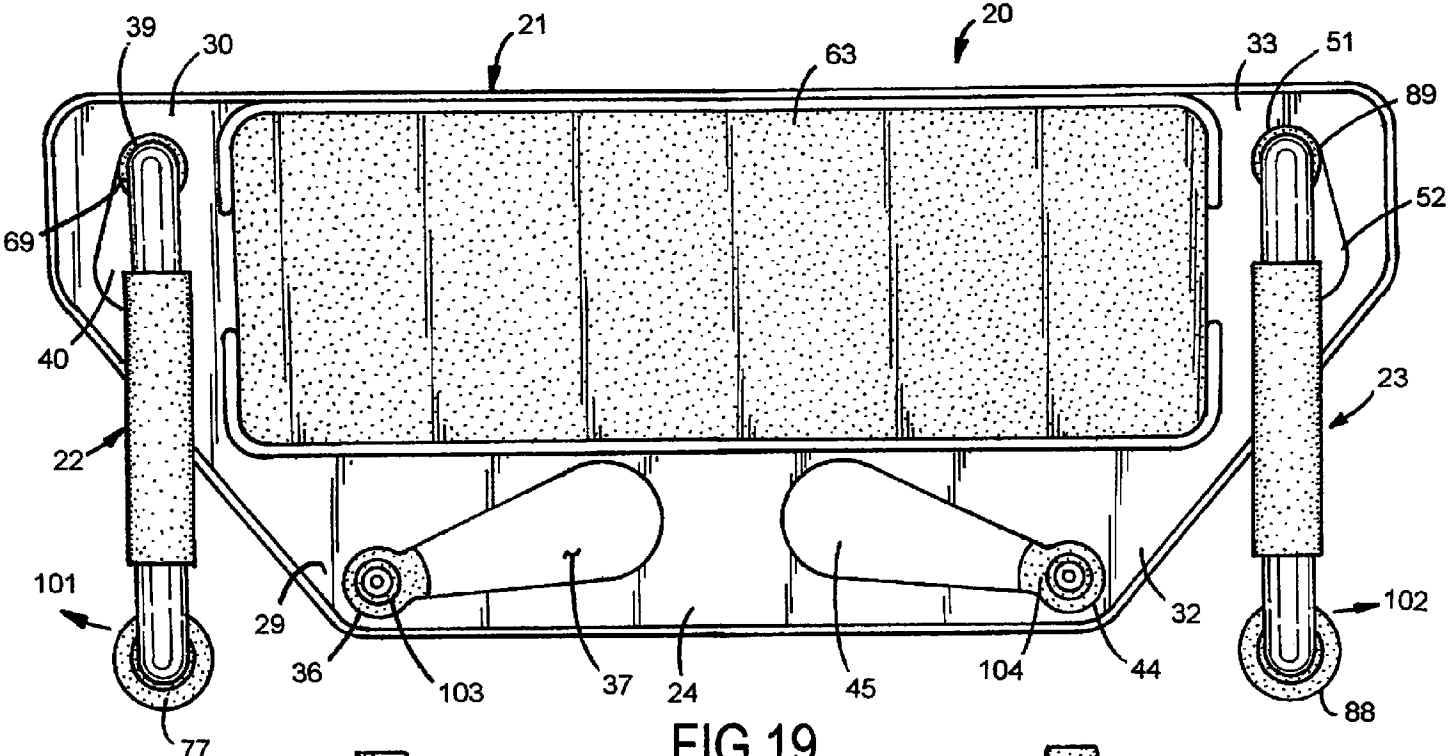
FIG. 19 is a top plan view of a modification of the kneeler of FIG. 1.
Figure 21:
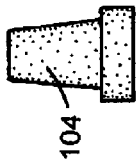
FIGS. 20 and 21 are front elevational views of the additional feet for the modification of the kneeler of FIG. 19.
Figure 20:
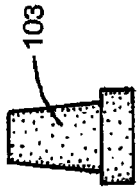

An alternative use of kneeler 20, shown in FIG. 19, illustrates handles 22 and 23 with feet 69 and 89 located in pockets 39 and 51 and feet 77 and 88 laterally spaced from platform 21. Handles 22 and 23 are laterally moved, shown by arrows 101 and 102, away from pockets 36 and 44. Feet 77 and 88 are located on a support surface, such as a floor, to maintain handles 22 and 23 in level position on a support surface. Additional feet 103 and 104 are located in pockets 36 and 44 to maintain platform 21 in a level position on a support surface. Feet 103 and 104, shown in FIGS. 22 and 23, have the same size, shape and material as foot 89 shown in FIG. 6.

A preferred embodiment of the kneeler has been illustrated and described. Change sin the structures and materials of the kneeler may be made by a person skilled in the art without departing from the kneelers defined in the following claims.

The invention claimed is:

1. A kneeler for supporting a person in a kneeling position and facilitating a person to move from an upright position to a kneeling position and arising from a kneeling position back to an upright position comprising: a platform having a first end and a second end opposite the first end, said first end including a first front corner and a second rear corner, said second end including a third front corner and a fourth rear corner, a first boss joined to and extended downwardly from the first corner of the platform, a second boss joined to and extended downward from the second corner of the platform, a third boss joined to and extended downward from the third corner of the platform, a fourth boss joined to and extended from the fourth corner of the platform, each of said first, second, third and fourth bosses having an upwardly converging wall providing first, second, third and fourth pockets, each associated with the first, second, third, or fourth boss, respectively, said platform having a first opening with an entrance to the first pocket, a second opening with an entrance to the second pocket, a third opening with an entrance to the third pocket and a fourth opening with an entrance to the fourth pocket, a first handle having first and second legs, a first foot connected to the first leg, said first foot having a sole and upright converging conical stem located in the first pocket in surface engagement with the converging wall around the first pocket, a second foot connected to the second leg, said second foot having a sole and upright converging conical stem located in the second pocket in surface engagement with the converging wall around the second pocket, a second handle having first and second legs, a third foot connected to the first leg of the second handle, said third foot having a sole and upright converging conical stem located in the third pocket in surface engagement with the converging wall around the third pocket, a fourth foot connected to the second leg of the second handle, said fourth foot having a sole and upright converging conical stem located in the fourth pocket in surface engagement with the converging wall around the fourth pocket, and said first, second, third and fourth openings in the platform each have a portion thereof larger in size than the size of the soles of the first, second, third and fourth feet whereby the first, second, third and fourth feet can be moved respectively through the first, second, third and fourth openings and the stems of the first, second, third and fourth feet can be moved respectively into the first, second, third and fourth pockets to attach the first and second handles to the platform.

2. The kneeler of claim 1 wherein:

the first and third corners of the platform are laterally aligned in the platform and the second and fourth corners of the platform are laterally aligned in the platform.

3. The kneeler of claim 1 wherein:

each of the first, second, third and fourth openings has a large end portion, the distance between the large end portions of the first and second openings is equal to the distance between the first and second pockets and the distance between the large end portions of the third and fourth openings is equal to the distance between the third and fourth pockets.

4. The kneeler of claim 1 wherein:

the second opening in the platform extends toward the fourth opening in the platform.

5. The kneeler of claim 1 wherein:

the first opening extends vertically in the platform, the second opening extends transversely in the platform, the third opening extends vertically in the platform, and the fourth opening extends transversely in the platform toward the second opening.

6. The kneeler of claim 1 wherein:

the first and second legs of the first handle comprise antimicrobial copper members and the first and second legs of the second handles comprise antimicrobial copper members.

7. The kneeler of claim 1 wherein:

the first handle is an inverted U-shaped member including the first and second legs and a first cross member joined to the first and second legs, a first sleeve located on the first cross member, the second handle is an inverted U-shaped member including the first and second legs and a second cross member joined to the first and second legs, and a second sleeve located on the second cross member.

8. The kneeler of claim 7 wherein:

the first and second legs of the first handle and the first cross member, and the first and second legs of the second handle and the second cross member comprise antimicrobial copper members.

9. The kneeler of claim 1 wherein:

the platform has a flat top surface located between the first and second handles, a flat cushion located on and covering said flat top surface of the platform, and attaching material securing the cushion to said flat top surface of the platform.

10. A kneeler for supporting a person in a kneeling position and facilitating a person to move from an upright position to a kneeling position and arising from a kneeling position back to an upright position comprising:

a platform having a first end and a second end opposite the first end, a first handle attached to the first end of the platform, a second handle attached to the second end of the platform, first and second bosses on the first end of the platform, each of said first and second bosses having an upwardly converging wall providing first and second pockets, each associated with the first or second boss, respectively, said platform having a first opening in communication with the first pocket and a second opening open in communication with the second pocket, third and fourth bosses on the second end of the platform, each of said third and fourth bosses having an upwardly converging wall providing third and fourth pockets, each associated with the third or fourth boss, respectively, said platform having a third opening in communication with the third pocket and a fourth opening in communication with the fourth pocket, said first handle having first and second legs, a first foot connected to the first leg, said first foot having a sole and upright converging conical stem located in the first pocket in surface engagement with the converging wall around the first pocket, a second foot connected to the second leg, said second foot having a sole and upright converging conical stem located in the second pocket in surface engagement with the converging wall around the second pocket, said second handle having first and second legs, a third foot connected to the first leg of the second handle, said third foot having a sole and upright converging conical stem located in the third pocket in surface engagement with the converging wall around the third pocket, a fourth foot connected to the second leg of the second handle, said fourth foot having a sole and upright converging conical stem located in the fourth pocket in surface engagement with the converging wall around the fourth pocket, said first, second, third and fourth openings in the platform each have a portion thereof larger in size than the size of the soles of the first, second, third and fourth feet whereby the first, second, third and fourth feet can be moved respectively through the first, second, third and fourth openings and moved respectively into the first, second, third and fourth pockets to attach the first and second handles to the platform.

11. The kneeler of claim 10 wherein:

the first opening has an entrance open to the first pocket, the second opening has an entrance open to the second pocket, the third opening has an entrance open to the third pocket, and the fourth opening has an entrance open to the fourth pocket.

12. The kneeler of claim 10 wherein:

each of the first, second, third and fourth openings has a large end portion, the distance between the large end portions of the first and second openings is equal to the distance between the first and second pockets, and the distance between the large end portions of the third and fourth openings is equal to the distance between the third and fourth pockets.

13. The kneeler of claim 10 wherein:

the second opening in the platform extends toward the fourth opening in the platform.

14. The kneeler of claim 10 wherein:

the first opening extends vertically in the platform, the second opening extends transversely in the platform, the third opening extends vertically in the platform, and the fourth opening extends transversely in the platform toward the second opening.

15. The kneeler of claim 10 wherein:

the first and second legs of the first handle comprise antimicrobial copper members and the first and second legs of the second handles comprise antimicrobial copper members.

16. The kneeler of claim 10 wherein:

the first handle is an inverted U-shaped member including the first and second legs and a first cross member joined to the first and second legs, a first sleeve located on the first cross member, the second handle is an inverted U-shaped member including the first and second legs of the second handle and a second cross member joined to the first and second legs of the second handle, and a second sleeve located on the second cross member.

17. The kneeler of claim 16 wherein:

the first and second legs and first cross member and the first and second legs and second cross member comprise antimicrobial copper members.

18. A kneeler for supporting a person in a kneeling position and facilitating a person to move from an upright position to a kneeling position and arising from a kneeling position back to an upright position comprising:

a platform having a first end and a second end opposite the first end, the first end including spaced first and second corners, the second end including spaced third and fourth corners, a first boss joined to the first corner of the platform, a second boss joined to the second corner of the platform, a third boss joined to the third corner of the platform, a fourth boss joined to the fourth corner of the platform, each of said first, second, third and fourth bosses having a wall providing first, second, third and fourth pockets, each associated with the first, second, third, or fourth boss, respectively, said platform having openings with entrances open to the first, second, third and fourth pockets, a first handle attached to the first and second bosses, said first handle having first and second legs, a first foot attached to the first leg located in the first pocket, a second foot attached to the second leg located in the second pocket thereby connecting the first handle to the first end of the platform, a second handle attached to the third and fourth bosses, said second handle having first and second legs, a third foot attached to the first leg of the second handle located in the third pocket, a fourth foot attached to the second leg of the second handle located in the fourth pocket thereby connecting the second handle to the second end of the platform, said openings in the platform each have a portion thereof larger in size than each of the first, second, third and fourth feet whereby the first, second, third and fourth feet can be moved respectively through the openings and the entrances and into the first, second, third and fourth pockets to attach the first and second handles to the platform.

19. The kneeler of claim 18 wherein:

the first and third corners of the platform are laterally aligned in the platform and the second and fourth corners of the platform are laterally aligned in the platform.

20. The kneeler of claim 18 wherein:

the platform has a top and a bottom, said first, second, third and fourth bosses project downward from the bottom of the platform.

21. The kneeler of claim 18 wherein:

the wall of each of the first, second, third and fourth bosses is an upward converging wall, and each foot includes an upward converging conical stem located in surface engagement with an upwardly converging wall of a boss whereby the first and second handles are connected to the platform.

22. The kneeler of claim 18 wherein:

the first and second legs of the first handle comprise antimicrobial copper members and the first and second legs of the second handles comprise antimicrobial cooper members.

23. The kneeler of claim 18 wherein:

the first handle is an inverted U-shaped member including the first and second legs and a first cross member joined to the first and second legs, a first sleeve located on the first cross member, the second handle is an inverted U-shaped member including the first and second legs and a second cross member joined to the first and second legs, and a second sleeve located on the second cross member.

24. The kneeler of claim 23 wherein:

the first and second legs of the first handle and the first cross member, and the first and second legs of the second handle and the second cross member comprise antimicrobial copper members.

25. The kneeler of claim 18 wherein:

each of the openings in the platform have a large end portion opposite a respective entrance, and the distance between the large end portions of adjacent openings is equal to the distance between the first and second pockets and the distance between the third and fourth pockets.

* * * * *